US005283721A

United States Patent [19]

Powell

[11] Patent Number: 5,283,721

[45] Date of Patent: Feb. 1, 1994

[54] SELF MOUNTING REFRIGERATOR LIGHT HEAT SHIELD

[75] Inventor: John M. Powell, Charlestown, Ind.

[73] Assignee: General Electric Company, Louisville, Ky.

[21] Appl. No.: 35,611

[22] Filed: Mar. 23, 1993

[51] Int. Cl.[5] ..... H25D 27/00

[52] U.S. Cl. ..... 362/92; 312/401; 362/294; 362/457

[58] Field of Search ..... 362/92, 94, 294, 457, 362/458; 312/401, 406, 223.5

[56] References Cited

U.S. PATENT DOCUMENTS 4,280,173 7/1981 Bradley et al. ..... 362/294
4,544,992 10/1985 Cover ..... 362/294

*Primary Examiner*—Richard R. Cole
*Assistant Examiner*—Sara S. Raab
*Attorney, Agent, or Firm*—H. Neil Houser

[57] ABSTRACT

A refrigerator includes an outer cabinet and an inner liner separated by insulation. The liner includes a plurality of walls defining a compartment to receive items to be refrigerated. An electric light is positioned adjacent to a first of the liner walls. A second of the liner walls disposed perpendicular to the first wall has three spaced apart slots positioned closer to the first wall than the light to the first wall. A shield is positioned between the light and the first wall and includes three tabs received in the slots in the second wall. The middle tab has a pair of lateral ears with rest positions angled with respect to the long axis of the corresponding slot. The ears flex as the tab is inserted through the slot and then return to their rest position to overlie the second liner wall. The other tabs also are angled with respect to their slots to firmly engage the second wall when installed. The shield also has oppositely projecting feet extending perpendicular to the shield and positioned adjacent the second wall so that the shield is positively positioned between the light and the first wall.

9 Claims, 1 Drawing Sheet

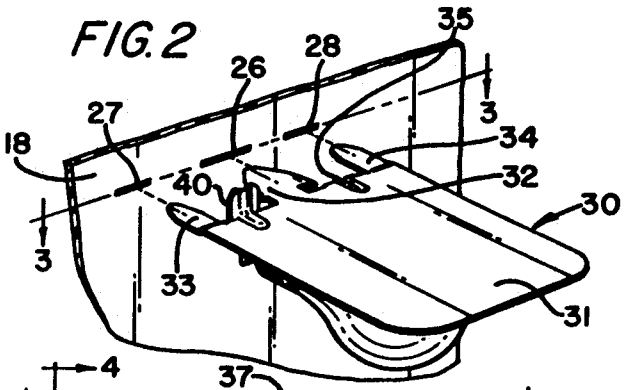
FIG. 2
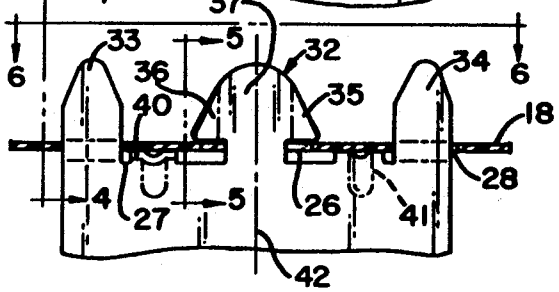
FIG. 3
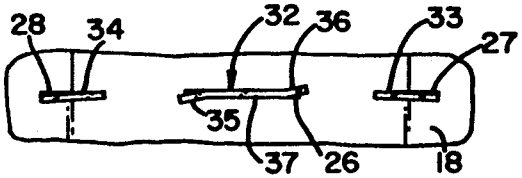
FIG. 6
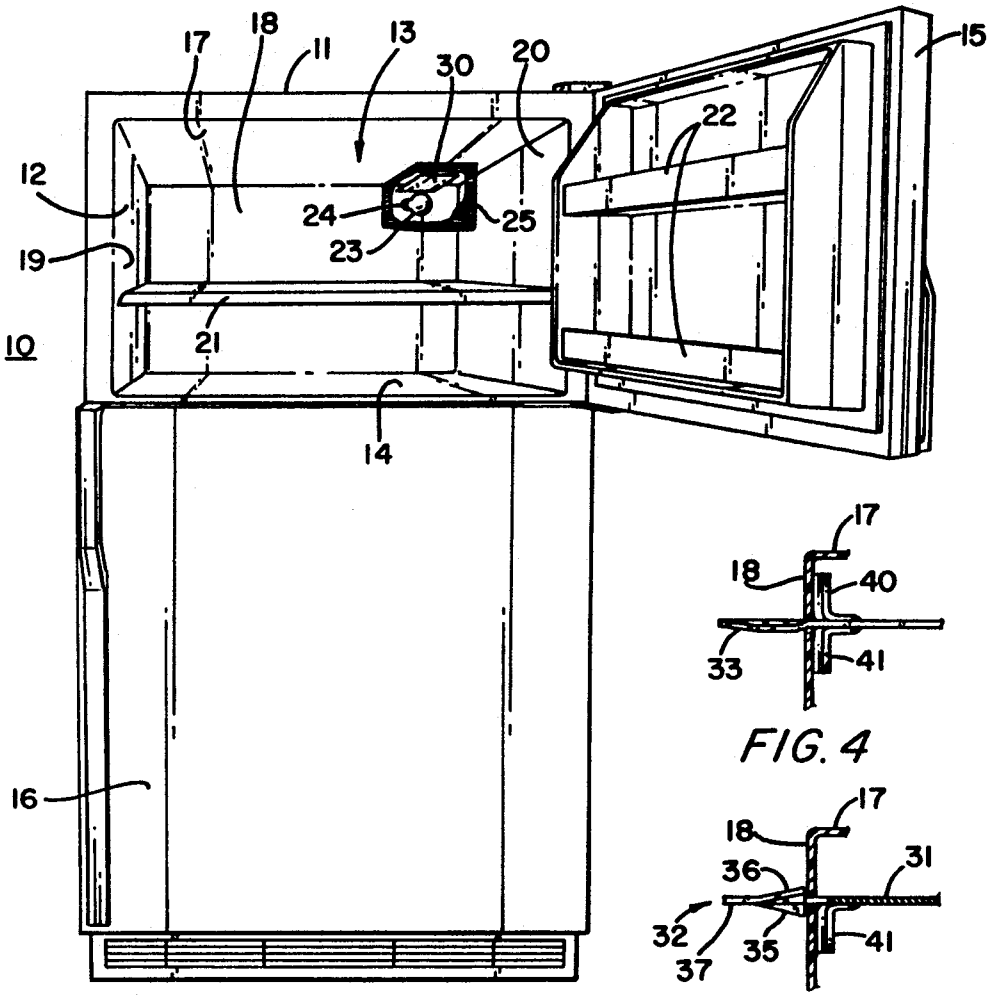
FIG. 1
FIG. 4
FIG. 5

SELF MOUNTING REFRIGERATOR LIGHT HEAT SHIELD

BACKGROUND OF THE INVENTION

Modern day refrigerators typically are manufactured using molded plastic liners to form the compartments for storing the items to be refrigerated. Such constructions have numerous advantages. For example the liner can be essentially joint and seam free, enhancing its cleanability. Also such materials are easy to work with and involve relatively little waste. However, one disadvantage is that the liner may be subject to discoloration and damage under the influence of localized heating as from the lamp normally included in such refrigerators to help the user find items in the compartment. It will be understood that it is desirable to place such lamps or lights as close to at least one liner wall as possible in order to minimize the lamp's interference with storage of items in the compartment. Many refrigerators include shields to protect the adjacent wall from the heat of the lamp. Typical shields are relatively complex in shape and require accessories and tools, like screws and screw drivers, to mount them in the refrigerator compartment.

SUMMARY OF THE INVENTION

It is an object of this invention to provide an improved light heat shield in a refrigerator.

It is another object of this invention to provide such an improved shield that is self-attaching to the liner.

It is another object of this invention to provide such a shield that is easily and securely mounted to a liner wall without the need of tools or accessories.

In accordance with one embodiment of the invention, a refrigerator includes a liner having walls defining a refrigerated compartment and a light is positioned adjacent a first of the liner walls. A second liner wall, perpendicular to the first wall has a plurality of slots extending along an axis parallel to the first wall and closer to it than is the light. A shield, positioned between the light and the first wall, includes a plurality of tabs received in corresponding slots. At least one of the tabs has a portion with an at rest position angled relative to the corresponding slot so as to overlie the wall. The shield also includes oppositely projecting feet extending generally perpendicular to the shield and positioned adjacent to the second wall so that the shield is positively positioned between the light and the first wall.

BRIEF DESCRIPTION OF THE DRAWINGS

In the accompanying drawing:

FIG. 1 is a front perspective view of a household refrigerator with the freezer door shown in its open position to illustrate positioning of a light and shield in accordance with one embodiment of the present invention.

FIG. 2 is an exploded fragmentary view of a portion of the rear wall of the freezer of FIG. 1, with the shield removed from the wall.

FIG. 3 is a fragmentary cross-section view, generally as seen along line 3—3 in FIG. 2, with the shield assembled to the wall.

FIG. 4 is a fragmentary sectional view as seen along line 4—4 in FIG. 3.

FIG. 5 is a fragmentary view as seen along line 5—5 in FIG. 3.

FIG. 6 is a fragmentary elevational view of the other side of the liner wall, as seen at line 6—6 in FIG. 3 showing the shield tabs inserted in the slots in the wall.

DETAILED DESCRIPTION OF PREFERRED EMBODIMENT

While the present invention is applicable to any refrigerator with one or more refrigerated compartments for storing foods and other items to be frozen or otherwise refrigerated, for purposes of illustration FIG. 1 depicts a typical two compartment refrigerator of the top mount variety. That is, the freezer compartment is positioned or mounted above the fresh food compartment. While FIG. 1 illustrates a light shield in a freezer compartment, it will be understood that fresh food compartments have similar lights with similar issues and the present invention is equally applicable to such compartments.

The refrigerator 10 includes an outer cabinet 11 and an inner liner 12 defining an upper freezer compartment 13 and a lower fresh food compartment, not shown, separated by an internal wall 14. Access to the freezer is provided by a door 15 while access to the fresh food compartment is provided by a door 16. Typically the liner 12 includes a top wall 17, a rear wall 18 and side walls 19 and 20, which, together with wall 14, define the freezer compartment. It will be understood that wall 14 dividing the freezer and fresh food compartments conveniently may be formed integrally with the liner or may be a separate structure.

Conveniently one or more racks or shelves, such as that shown at 21, are provided within the freezer and shelves or bins 22 are provided on the inside of the freezer door 15 for ease and versatility in storing items in the freezer. It is desirable to provide a light 23, mounted in an electric outlet 24 connected to the electric supply, to illuminate the inside of the freezer when the door 15 is open and assist the user find items stored in the freezer. Often a diffuser 25 is positioned around the light to soften the light and reduce shadows. It is desirable to mount the light 23 as close as possible to a selected one of the freezer walls, in order to minimize the reduction in the effective storage space in the freezer. The close proximity of the light causes the adjacent area of the liner wall to be heated. Since modern liners 12 are normally formed from a plastic material such as, for example, vacuum formed polystyrene, such heating may adversely affect the liner material. Often it could cause the liner to discolor and may even cause it to crack. This is particularly true should a user inadvertently leave the door open for a long period of time, and in refrigerators which dealers use for demonstrations as such demonstration refrigerators are not refrigerated and the doors are left open for long periods of time. Thus for some time manufacturers have installed shields to protect the adjacent wall or walls from the heat generated by such lights. The present invention provides a shield arrangement which is effective and is easy to install without the necessity of any tools or accessories.

Since the light 23 is very close to top wall 17, a shield 30 is positioned between the light and the top wall to protect the wall from the heat generated by the light. The rear wall 18 of the liner is provided with three elongated slots 26, 27 and 28 spaced apart and extending along an axis indicated by line 3—3 in FIG. 2. The slots 26–28 are positioned closer to wall 17 than the light 23 and are in line with the light so that a shield mounted on wall 18 using the slots will protect the adjacent portion of wall 17 from the effects of the heat from light 23. Preferably the shield is manufactured of a die formed sheet metal. However, it may be formed of any suitable material which can tolerate the heat from an adjacent light and is sturdy enough not to sag into the light, such as for example, a heat resistant molded plastic.

Referring now to FIGS. 3–6, the shield 30 includes a generally planar body portion 31 of rectilinear configuration. Three tabs 32, 33 and 34 project outwardly of a lateral edge of the body 31 and generally lie within the plane of that body. The tabs 32–34 are sized and positioned to fit within the slots 26–28. The center tab 32 is formed with a pair of oppositely disposed ears 35 and 36 which extend to each side of the central portion 37 of the tab and are spaced from the edge of the shield body 31 a distance sufficient to permit the liner 12 to fit between them. The ears have rest positions or configurations angled out of the plane of the shield. More particularly, as seen in FIG. 6, ear 36 projects above the body 31 and ear 35 projects below the body 31. The ears flex into alignment with the slot when tab 32 is inserted through slot 26 and then return to their rest configuration once they are on the other side of the liner. At that time the ears overlap the liner adjacent slot 26 and secure tab 32 against removal from slot 26.

If desired, the side tabs 33–34 can be formed with the same general shape as center tab 32. However, I have found that these tabs conveniently may be made more narrow than center tab 32 and can be twisted or canted out of the plane of the shield, as shown in FIG. 6. With such configurations these tabs will firmly bear against the edges of slots 27 and 28 and help secure the shield 30 in position against wall 18.

A pair of feet 40 and 41 project from the edge of shield body adjacent the tabs 32–34. More particularly, foot 40 is located between tabs 32 and 33 and projects in one direction perpendicular to body portion 31 while foot 41 is located between tabs 32 and 34 and projects in the opposite direction perpendicular to body 31.

The shield 30 is mounted to liner wall 18 by fully inserting the tabs 32–34 into slots 26–28 so that the ears 35–36 are on the opposite side of the liner than the body 31. In that position they resume their rest configuration and overlap the liner. Thus the liner is sandwiched between the ears and the adjacent edge of body 31 to hold the shield in place. This holding effect is enhanced by the engagement of the tabs 33–34 with the edges of slots 27–28. In the event it is desired to use a particularly large shield the tabs 33–34 can be configured like tab 32 to further enhance the holding effect. The feet 40–41 closely overlie the freezer compartment (inside) side of liner wall 18 and constrain the shield from sagging or rotating about the slots. Preferably the slots are symmetric about the center of slot 26 while the tabs and feet are symmetric about the center line 42 of tab 32 so that the shield can be mounted in the slots with either side toward the light.

Since the shield is positioned between the light and the wall 17 it protects the wall from the effects of the light, particularly the heat given off by the light. If the light is positioned very close to two walls, either two shields can be mounted at right angles to each other or a right angled shield can be mounted to simultaneously protect both walls.

What is claimed is:

1. For use in a refrigerator including a liner forming a compartment to receive items to be refrigerated, a shield to protect a first predetermined wall of the liner from heat from an adjacent light, said shield including:

a sheet of material sized to effectively shield the first wall of the liner from the light;

three tabs extending outwardly of one edge of said sheet for receipt in corresponding slots in a second predetermined wall of the liner, said tabs being symmetrical about a line through the center of the middle one of the tabs;

said middle tab including laterally projecting ears having rest positions angled with respect to the remainder of that tab, said ears flexing to pass through the corresponding slot and then returning to their rest position so as to overlie the second liner wall; and a pair of oppositely projecting feet extending generally perpendicular to said sheet and positioned to lie closely adjacent said second wall when said shield is mounted to said second wall.

2. A shield as set forth in claim 1, wherein: each of the outer ones of said tabs is formed to firmly engage a portion of said second liner wall defining the corresponding slot when said shield is mounted to said second wall.

3. A shield as set forth in claim 2, wherein: said feet are positioned on opposite sides of said middle tab.

4. A shield as set forth in claim 3, wherein: said shield is die formed sheet metal.

5. A refrigerator including:

an inner liner and an outer cabinet spaced apart to provide a space substantially filled with insulation;

said liner including a plurality of walls defining a compartment to receive items to be refrigerated;

an electrically energized light positioned adjacent a first of said liner walls;

a second of said liner walls disposed generally plurality of spaced apart slots extending along an axis parallel to said first wall and closer to said first wall than said light;

a shield positioned between said light and said first wall, said shield including a plurality of spaced apart tabs received in corresponding ones of said slots, at least one of said tabs including at least a portion having a rest position angled relative to the corresponding slot so as to overlie said second wall; and said shield also including oppositely projecting feet extending generally perpendicular to said shield and positioned adjacent said second wall so that said shield is positively positioned between said light and said first wall.

6. A refrigerator as set forth in claim 5, wherein: said shield includes three tabs symmetrically arranged about a center line of the middle one of said tabs.

7. A refrigerator as set forth in claim 6, wherein: said middle tab has a pair of laterally positioned ears, said ears having rest positions angled with respect to the axis of said slots, said ears flexing to pass through the corresponding slot as said shield is positioned adjacent one side of said second wall and then returning to their rest positions to overlie the opposite side of said second wall.

8. A refrigerator as set forth in claim 7, wherein: the other of said tabs have rest positions angled with respect to said axis so as to firmly engage said second wall when said other tabs are inserted in said corresponding slots.

9. A refrigerator as set forth in claim 8, wherein: said shield is die formed sheet metal.

* * * * *